United States Patent [19]

Lennon

[11] Patent Number: 4,804,326

[45] Date of Patent: Feb. 14, 1989

[54] SWIMMING INSTRUCTION AND TRAINING AID

[76] Inventor: Paul R. Lennon, 2734 Auburn St., Los Angeles, Calif. 90039

[21] Appl. No.: 3,477

[22] Filed: Jan. 15, 1987

[51] Int. Cl.[4] ..... A63B 69/12

[52] U.S. Cl. ..... 434/254; 272/71; 441/59; 441/60

[58] Field of Search ..... 434/254; 272/1 B, 71, 272/116, 119, 130; 441/60; 2/7, 170, 181.8, 182.3, 182.5; 447/59

[56] References Cited

U.S. PATENT DOCUMENTS

| | | | |
|---|---|---|---|
| 2,127,926 | 8/1938 | Mason | 2/170 |
| 2,692,995 | 11/1954 | Bihan | 441/59 X |
| 3,170,175 | 2/1965 | Brandt | 441/60 |
| 3,427,022 | 2/1969 | Ward | 272/71 X |
| 3,835,493 | 9/1974 | Grivda | 441/59 X |
| 3,913,907 | 10/1975 | Baker | 272/71 X |
| 4,130,922 | 12/1978 | Mackenroth, III et al. | 2/182.3 X |
| 4,239,211 | 12/1980 | Wilkerson | 272/119 |
| 4,300,759 | 11/1981 | Caplan | 272/71 X |
| 4,671,507 | 6/1987 | Huttner | 441/60 X |

FOREIGN PATENT DOCUMENTS

| | | | |
|---|---|---|---|
| 1599666 | 10/1981 | United Kingdom | 441/60 |

OTHER PUBLICATIONS

Swimming and Water Safety Textbook, p. 28, 1968.

*Primary Examiner*—Richard J. Apley
*Assistant Examiner*—Robert D. Bahr
*Attorney, Agent, or Firm*—Noel F. Heal

[57] ABSTRACT

A flotation device worn on the ankle and a related method for its use. The device is a sleeve of resilient, cellular material providing only small buoyancy, but because the device is located at a relatively great distance from the body's center of buoyancy, it has the effect of maintaining the swimmer's legs in a near-horizontal floating position, even if the person does not float naturally in this position. Use of the device greatly facilitates the teaching of floating and survival techniques to beginning swimmers, and various swimming strokes to all swimmers.

5 Claims, 1 Drawing Sheet

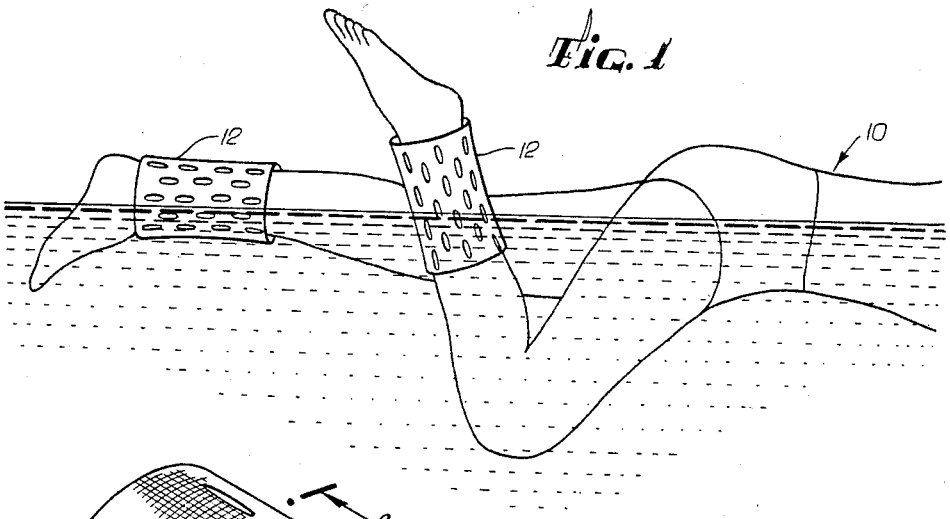
Fig. 1
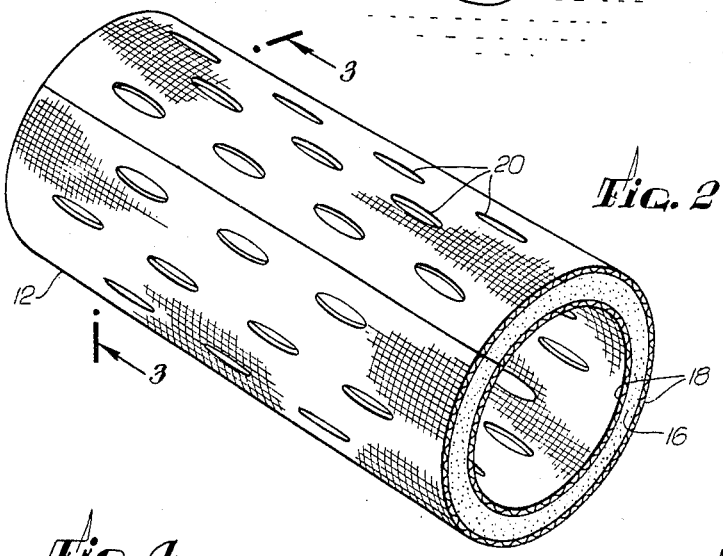
Fig. 2
Fig. 4
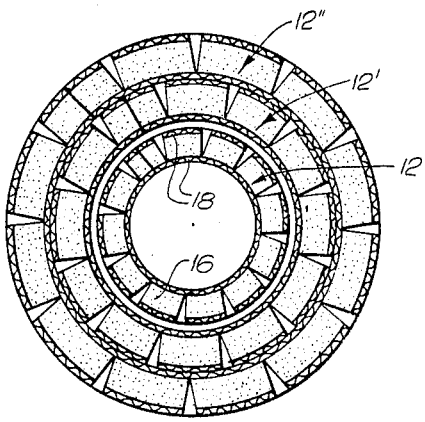
Fig. 3
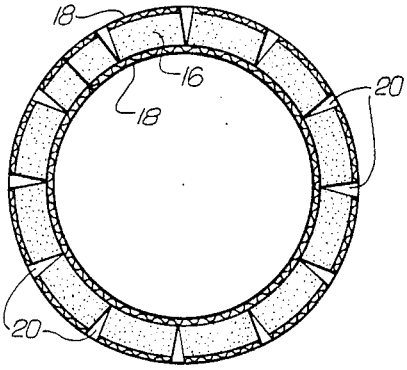

SWIMMING INSTRUCTION AND TRAINING AID

BACKGROUND OF THE INVENTION

This invention relates generally to equipment used in swimming instruction and training, and, more particularly, to flotation devices used in swimming.

Flotation devices have, in a general sense, long been used in swimming instruction and training. Inflatable "water wings" were once commonly used for buoyancy when teaching young children to swim. However, the present invention is concerned with a very specific flotation problem associated with swimming instruction. With a full breath of air, practically everyone will float in water, but there is a wide variation in the degree to which different people will float. Many people, particularly women, float easily on their backs in a horizontal position, even when their lungs are not fully inflated. Others float in a more nearly vertical orientation, with their legs at an angle of forty-five degrees or more below the horizontal position. Persons in this latter group are often referred to as "sinkers," but a more accurate term is "vertical floaters." The factors that determine whether a person is a horizontal or a vertical floater are diverse, and not completely understood. The principal ones appear to be weight distribution, fat-to-muscle weight ratio, and bone weight.

Vertical floaters can usually attain a horizontal position by maintaining a low flutter kick, or by suitably positioning their arms stretched out over their heads to balance the weight of their legs. However, these solutions to the problem can be distracting or impractical when the person is receiving instruction for a particular swimming stroke. Some vertical floaters remain poor swimmers or non-swimmers all of their lives because of the increased difficulty of learning to swim without the ability to float horizontally. A significant number of people are aquaphobics who have never learned to swim because of a fear associated with water. If an aquaphobic is also a vertical floater, there is a reduced possibility of this person ever overcoming the fear and achieving any level of confidence in the water, even with expert instruction.

One approach that is sometimes used in teaching the crawl stroke is to secure relatively large Styrofoam floats to the swimmer's legs. These apply a substantial buoyancy force, and permit the swimmer to concentrate on the arm stroke or breathing rhythm associated with the stroke. Floats known as "pull-buoys" are sometimes used by swimmers for the development of upper-body strength, to support their legs in an immobile position while their arms alone are used for propulsion. The use of such flotation devices has the disadvantage that they usually feel unnatural, awkward or clumsy to the swimmer, because of the relatively large buoyancy force that they provide. Moreover, for much the same reasons, such devices are not well suited for teaching beginning swimming. For beginning swimmers, a primary goal is to attain confidence in the front-floating and back-floating positions, coupled with the ability to make easy transitions between these positions. A large buoyant force on the legs helps with the flotation difficulty, but often does not instill confidence because of the clumsiness and relatively large buoyant forces associated with the devices.

It will be appreciated from the foregoing that there is still an important need for a suitable device to address all of these problems and difficulties. The present invention fulfills this need.

SUMMARY OF THE INVENTION

The present invention provides a subtle but significant flotation force at the ankles of the swimmer, sufficient to lift the swimmer's legs to a practically horizontal position when front-floating or back-floating. Basically, and in general terms, the device of the invention comprises an approximately cylindrical sleeve of resilient cellular material, with multiple performations through the thickness of the material to facilitate placement of the sleeve over the foot and on the ankle.

When a person floats in water, the center of buoyancy is located at the person's chest, since the inflated lungs provide the greatest buoyancy force on the body. Because the ankles are located at a relatively long distance from the lungs, horizontal equilibrium can be achieved with only a small flotation force located at the ankles. In most cases, only a single layer of the material, approximately $\frac{1}{8}$ to $\frac{1}{2}$ inch thick and several inches long is all that is needed to achieve the horizontal position. If greater flotation is needed, one or more additional sleeves can be applied over the first one, either in a concentric fashion, or distributed along the length of each leg. In all cases, the sleeve is scarcely noticeable by the swimmer. The beginning swimmer can then achieve proficiency and confidence in the various floating positions, and in making the transitions between these positions, typically within only a few hours instruction. The device of the invention can then be discarded and the swimmer will continue to be comfortable and proficient after a very short period of readjustment to the new flotation condition.

Similarly, the device of the invention greatly facilitates the teaching of swimming strokes, such as the crawl, and as a substitute for pull-buoys in the development of upper-body strength. The legs are held practically horizontal without any effort being required of the swimmer, who can then more easily concentrate on other aspects of the stroke. Moreover, unlike pull-buoys, the device of the invention permits separation and relative movement of the legs.

The presently preferred form of the device includes a cellular neoprene material surfaced on both sides with a nylon or similar fabric. The perforations through the sleeve render it much more resilient, so that it can be easily fitted over the foot, placed on the ankle, and remain in position there without movement and consequent distraction. In the presently preferred form of the device, the perforations are slits of approximately equal length and equal longitudinal and lateral spacing. That is to say, the slits are arranged in a staggered pattern of parallel rows, and their spacing both along and between the rows is the same as the slit length. This arrangement provides a high degree of elasticity in two dimensions, and greatly facilitates fitting and removal of the device. The device conforms easily to the shape of the leg, and has a low drag profile in the water.

It will be appreciated from the foregoing that the present invention represents a significant advance in the field of swimming instruction equipment. In particular, the invention provides a simple but highly effective technique for maintaining a swimmer in a practically horizontal position without the need for kicking and without cumbersome flotation devices that have been used in the past. Other aspects and advantages of the invention will become apparent from the following more detailed description, taken in conjunction with the accompanying drawings.

BRIEF DESCRIPTION OF THE DRAWINGS

FIG. 1 is a perspective view of the device of the invention as worn by a swimmer;

FIG. 2 is a perspective view of one embodiment of the invention device, shown to an enlarged scale with respect to FIG. 1;

FIG. 3 is a further enlarged sectional view taken substantially along the line 3—3 in FIG. 2; and FIG. 4 is an end view of three devices of the invention, sized to fit together concentrically.

DESCRIPTION OF THE PREFERRED EMBODIMENT

As shown in the drawings for purposes of illustration, the present invention is concerned with a flotation device used as a swimming instruction aid. In the past, flotation devices used on the legs have been cumbersome and have have provided too much buoyancy to instaill confidence in beginning swimmers.

In accordance with the invention, swimmers who are normally vertical floaters can achieve a horizontal floating position with practically no effort by wearing the device of the invention on their ankles. The device provides only a relatively small buoyant force but, because of its position in relation to the center of buoyancy, the device applies a relatively large rotational torque to the body, and lifts the legs to a practically horizontal position FIG. 1 shows a swimmer, indicated by reference numeral 10, wearing a pair of the devices 12 fitted over the ankles and extending part-way up the calf of each leg. One leg is shown bent only to illustrate the device 12 from a slightly different angle. Each device 12 is fitted snugly about the ankle and leg and, after a short time in the water, goes virtually unnoticed by the swimmer.

As shown in more detail in FIGS. 2 and 3, each device 12 is basically cylindrical in shape, although it may be slightly tapered to conform more closely to the contour of a leg, and is made from a resilient, cellular material. The material should also provide buoyancy in water. A suitable material is a synthetic rubber, such as neoprene, of much the same type as is used in divers wet suits. In the illustrative embodiment, the device includes a substantial thickness, ⅛ to ½ inch, of neoprene material, indicated at 16, surfaced on both sides by a suitable hard-wearing fabric, such as nylon, as indicated at 18. Neoprene is resilient, but does not stretch enough to be easily fitted over th foot. To facilitate fitting and removing the devices 12, all three layers of the device are perforated with slits 20 in a regular pattern. What appears to work best in this regard is a pattern in which the slits 20 are made in a direction parallel to the longitudinal axis of the device, are regularly spaced in rows, but are staggered in axial position from one row to the next. When the device is stretched in a radial direction, as when fitting it over the foot, the slits enlarge and the material may be stretched more easily in this direction without the possibility of tearing, although it still maintains its resilience and snug fit over the ankle.

It has been found from experience that the preferred configuration of the slits 20 is one in which their lateral and longitudinal spacing is the same. That is to say, the distance between two adjacent slits in the same row is approximately equal to the distance between two adjacent rows. In the illustrated form of the device, this inter-slit spacing is also approximately equal to the slot length, but this is not a necessary condition. The equidistant spacing of slits in both directions appears to provide optimum elasticity in both directions of stretching, and allows the device to conform more easily to the shape of the leg. Therefore, the device encounters very little drag while in the water, and has the feel of a "second skin" to the swimmer. This elasticity in both directions also permits a device of one size to be sretched to fit a wide range of foot and leg sizes. Although the slits 20 constitute a relatively large proportion of the total area of the device when worn over the ankle, the device still provides sufficient buoyancy to lift the legs to the horizontal position.

Each of the devices may be fabricated as a seamless cylinder or cone, but as a practical matter is more easily fabricated from a flat sheet of material formed into a sleeve with the use of a single longitudinal seam. The seam should preferably be stitched to withstand long-term damage from exposure to water and chemicals.

It may be desirable in some instances to fit more than one of the devices 12 on each leg. As shown in FIG. 4, additional devices 12' and 12'' may be sized to fit over the basic device 12, either in a concentric manner, or with multiple devices distributed along the length of the leg. Although wearing two or three of the devices on the same leg is more bulky, the multiple sleeves are still less cumbersome than other flotation devices that might be used, and the swimmer quickly adapts to them without significant inconvenience. When multiple devices are worn, they may be removed one at a time to minimize any difficulty in re-adapting to swimming without the devices.

It will be appreciated from the foregoing that the present invention represents a significant advance in the field of swimming instruction. For beginning swimmers who are vertical floaters, the device of the invention accelerates the learning of flotation and survival swimming skills. The device also facilitates the teaching of a number of swimming strokes and the development of upper-body strength, especially for persons who are vertical floaters. The invention not only provides a desired degree of buoyancy to the swimmer's legs, but also permits the legs to separate and move in any conventional kicking action. It will also be appreciated that, although an embodiment of the invention has been described in detail for purposes of illustration, various modifications may be made without departing from the spirit and scope of the invention. Accordingly, the invention is not to be limited except as by the appended claims.

I claim:

1. A swimming instruction and training aid, comprising:

a compact, lightweight flotation device for fitting over the ankle of a swimmer, having an axial length exceeding its diameter and being formed from a substantial thickness of cellular synthetic rubber material formed into a hollow, approximately cylindrical sleeve, and a covering of hard-wearing fabric adhered to the inner and outer surfaces of the sleeve, having a plurality of elongated slits formed through the walls of the sleeve, the slits being parallel to the longitudinal axis of the sleeve and in a configuration in which the slit positions are staggered in position from one row to the next to increase its stretchability and facilitate its fitting and removal over the foot, wherein the multiple perforations are separate and not connected with each other, to maintain the structural integrity of the material while still facilitating longitudinal and circumferential stretching, and whereby the device provides sufficient buoyancy to lift the swimmer's legs to a near-horizontal position without effort by the swimmer.

2. A swimming instruction and training aid as defined in claim 1, wherein:

the elongated slits are uniformly spaced along each row by approximately the length of each slit, and are spaced between rows by approximately the same distance.

3. A swimming instruction and training aid as defined in claim 1, wherein:

the device is sized to fit on the leg of a swimmer with another device of the same construction, to permit multiple devices to be comfortably worn on the same leg.

4. A swimming instruction and training aid as defined in claim 3, wherein the devices are worn concentrically.

5. A method of providing swimming instruction, comprising the steps of:

fitting a cylindrical flotation device on each ankle of a swimmer, to raise the legs to a near-horizontal floating position, the fitting step including inserting each foot in the device and stretching the device sufficiently both axially and circumferentially to draw it over the heel of the foot and onto the ankle;

instucting the swimmer to perform strokes or procedures that are easier to learn with the legs floating horizontally;

adding additional flotation devices of similar construction concentrically over the swimmer's ankle, as needed to provide a sufficient buoyancy force for a particular swimmer; and removing the flotation devices after the swimmer has become proficient in performing the procedures.

* * * * *